US006661395B2

(12) United States Patent
Lo et al.

(10) Patent No.: US 6,661,395 B2
(45) Date of Patent: Dec. 9, 2003

(54) METHOD AND DEVICE TO DRIVE A PLASMA DISPLAY

(75) Inventors: Lih-Shang Lo, Jubei (TW); Jih-Fon Huang, Hsinchu Hsien (TW); Bing-Ming Ho, Chiai Hsien (TW)

(73) Assignee: AU Optronics Corp., Hsinchu (TW)

( * ) Notice: Subject to any disclaimer, the term of this patent is extended or adjusted under 35 U.S.C. 154(b) by 0 days.

(21) Appl. No.: 10/194,083

(22) Filed: Jul. 11, 2002

(65) Prior Publication Data

US 2003/0057855 A1 Mar. 27, 2003

(30) Foreign Application Priority Data

Aug. 31, 2001 (TW) ..... 90121578 A

(51) Int. Cl.[7] ..... G09G 3/28; G09G 3/36
(52) U.S. Cl. ..... 345/60; 315/169.3; 345/87
(58) Field of Search ..... 315/169.3; 345/87, 345/94, 60, 72, 101, 148, 103, 208

(56) References Cited

U.S. PATENT DOCUMENTS 6,037,920 A * 3/2000 Mizutome et al. ..... 345/87
2001/0020923 A1 * 9/2001 Homma ..... 345/60
2002/0063662 A1 * 5/2002 Nagakubo et al. ..... 345/60

* cited by examiner

*Primary Examiner*—Don Wong
*Assistant Examiner*—Chuc Tran
(74) *Attorney, Agent, or Firm*—Ladas & Parry

(57) ABSTRACT

A plasma display driving system. The system includes a controlling circuit, a scan driver, and a data driver. The controlling circuit outputs a first scan driving pulse and a second scan driving pulse, and a third scan driving pulse during addressing period. The frequency of the first scan driving pulse is higher than the second scan driving pulse, and the frequency of the second scan driving pulse is higher than the third scan driving pulse. The scan driver drives the first scanning electrodes, the second scanning electrodes, and the third scanning electrodes according to the first scan driving pulse, the second scan driving pulse, and the third scan driving pulse respectively. The data driver drives the first data electrodes, the second data electrodes, and the third data electrodes responding to the first scanning electrodes, the second scanning electrodes and the third scanning electrodes when the scanning electrodes are driven.

7 Claims, 9 Drawing Sheets

METHOD AND DEVICE TO DRIVE A PLASMA DISPLAY

BACKGROUND OF THE INVENTION

1. Field of the Invention

The present invention relates in general to a system and method to drive a plasma display. In particular, the present invention relates to a plasma display driving system and a method of driving a plasma display, by changing scanning frequency, to reduce the scanning time during address period.

2. Description of the Related Art

An AC memory type plasma display panel (referred to as PDP hereafter) has many advantages such as small size, high display ability, and high reliability. Thus, the PDP can be found in various wide screen electronic devices for displaying output data. The current method of driving a plasma display panel is achieved through a plurality of subframe-display operations, which altogether constitute a full frame-display operation. For example, a picture frame in a plasma display panel with 256 gray levels may comprise eight subframes SF0~SF7 as shown in FIG. 1A. Each subframe-display operation comprises steps of resetting, scanning, and sustaining the display signal. Specifically, a plasma display panel is driven by a driving signal that comprises an erasing period, a addressing period, and a sustaining period. During the erasing period, residual ions of each illuminant cell of a PDP are erased using a voltage pulse having a pulse width shorter than a sustaining pulse. During the addressing period, external data are input using a voltage pulse having a voltage higher than a sustaining pulse of the erasing period. During the sustaining period, an AC voltage of a constant frequency is applied to avoid an ignition miss or incorrect display and to obtain a correct power margin.

FIG. 1B shows a cross section of a conventional PDP structure, and FIG. 1C shows a schematic top view of the data and scanning electrodes of the same PDP. As shown in FIG. 1B, a PDP is constructed by joining a front glass substrate 1 with a rear glass substrate 2, wherein data electrodes 3 for inputting external data are formed on the surface of the front glass substrate 1 that opposes the rear glass substrate 1. Furthermore, a plurality of ribs 4 is defined on the data electrodes 3 to form illuminant cells. A plurality of sustaining electrodes 7 and scanning electrodes 8 in parallel direction, on the other hand, are formed on the surface of the rear glass substrate 2 that opposes the front glass substrate 1, wherein the above-mentioned data electrodes 3 are formed perpendicular to both the sustaining electrodes 7 and the scanning electrodes 8. In addition, the surfaces of both the sustaining electrodes 7 and scanning electrodes 8 are coated with a dielectric layer 6 (such as a MgO layer) for protecting the surfaces of the electrodes. Furthermore, a fluorescence material 5 (such as phosphorous) is deposited between ribs (where the illuminant cells reside) for illumination to occur as soon as a voltage is applied. As shown in FIGS. 1C and 1D, a typical conventional plasma display panel comprises a plurality of row plasma display units (represented by L1~LN). Each row display unit has one of the plurality sustaining electrodes 7 (represented by a corresponding $X_1$~$X_N$), one of the plurality of parallel scanning electrodes 8 ($Y_1$~$Y_N$); for example, the first row display unit $L_1$ comprises the first sustaining electrode $X_1$, and the first scanning electrode $Y_1$. The plurality of illuminant cells of the first row display unit $L_1$ is driven by the $X_1$, $Y_1$ simultaneously during the sustaining period. The plurality of data electrodes 3 ($D_1$~$D_M$) are disposed perpendicular to both the sustaining electrodes 7 ($X_1$~$X_N$) and the scanning electrodes 8 ($Y_1$~$Y_N$). Each of the sustaining electrodes 7 ($X_1$~$X_N$) is connected to the others and thereby the electrodes can be driven synchronously. In contrast, each of the scanning electrodes 8 ($Y_1$~$Y_N$) is connected separately from the other electrodes so as to actuate each of the electrodes independently. Thus, external data are input to each illuminant cell of the plasma display panel via the data electrodes 3 ($D_1$~$D_M$) by controlling both the sustaining electrodes 7 ($X_1$~$X_N$) and the scanning electrodes 8 ($Y_1$~$Y_N$).

FIG. 2 is a driving signal diagram of various electrodes of the plasma display panel shown in FIGS. 1B, 1C, and 1D, which are driven according to the method of a prior art. Accordingly, a plasma display panel is driven by a driving signal that comprises an erasing period, an addressing period, and a sustaining period. During the erasing period, a very short pulse $V_W$ of a high voltage is applied to all of the sustaining electrodes 7 (including $X_1$~$X_N$), and all of the scanning electrodes 8 (including $Y_1$~$Y_N$) are connected to the ground $V_g$, so as to remove the remaining residual ions. At this point, no data electrodes 3 (including $D_1$~$D_M$) are driven yet. During the addressing period, a bias $V_K$ is applied to all of the sustaining electrodes 7 (including $X_1$~$X_N$), so the scanning electrodes 8 ($Y_1$~$Y_N$) can input external data sequentially via the data electrodes 3 ($D_1$~$D_M$) based on an addressing signal $V_Y$. At this point, the scanning electrodes 8 ($Y_1$~$Y_N$) are connected to a row address decoder (not shown in the figure) to receive an addressing signal, and the data electrodes 3 ($D_1$~$D_M$) are connected to external data to proceed writing operations. During the sustaining period, a periodic voltage pulse $V_S$ is alternately applied to the sustaining electrodes 7 ($X_1$~$X_N$) and the scanning electrodes 8 (including $Y_1$~$Y_N$) to maintain the luminance of the illuminant cells. FIG. 3 shows the timing chart of the output pulse of the scanning electrodes $Y_1$~$Y_N$. In FIG. 3, the scanning frequency of each scanning electrode is $f_p$.

As shown in FIG. 2, addressing cost most of the frame time. For a 600×400 256 color PDP as a example, if erasing period takes 150 us and each address line takes 3 us, then the erasing period and addressing period take 15.6 ms [(150+3×600)×8/1000=15.6], it is about 90% of one frame time (16.7 ms). Thus, the time for sustaining is too short to generate sufficient brightness.

SUMMARY OF THE INVENTION

The object of the present invention is to provide a plasma display driving system and a method to drive a plasma display. When misfiring does not occur, the frequency, pulse width, and interval of the signals output by the scanning electrodes are modified to decrease the addressing period. Thus, the sustaining period is increased to raise the brightness of the PDP.

To achieve the above-mentioned object, the present invention provides a plasma display driving system including a controlling circuit, a scan driver, and a data driver. The controlling circuit outputs a first scan driving pulse and a second scan driving pulse, and a third scan driving pulse during the addressing period. The frequency of the first scan driving pulse is higher than the second scan driving pulse, and the frequency of the second scan driving pulse is higher than the third scan driving pulse. The scan driver drives the first scanning electrodes, the second scanning electrodes, and the third scanning electrodes according to the first scan driving pulse, the second scan driving pulse, and the third scan driving pulse respectively. The data driver drives the first data electrodes, the second data electrodes, and the third data electrodes responding to the first scanning electrodes, the second scanning electrodes and the third scanning electrodes when the scanning electrodes are driven.

BRIEF DESCRIPTION OF THE DRAWINGS

The present invention will become more fully understood from the detailed description given hereinbelow and the accompanying drawings, given by way of illustration only and thus not intended to be limitative of the present invention.

DETAILED DESCRIPTION OF THE INVENTION

Figure 4A:
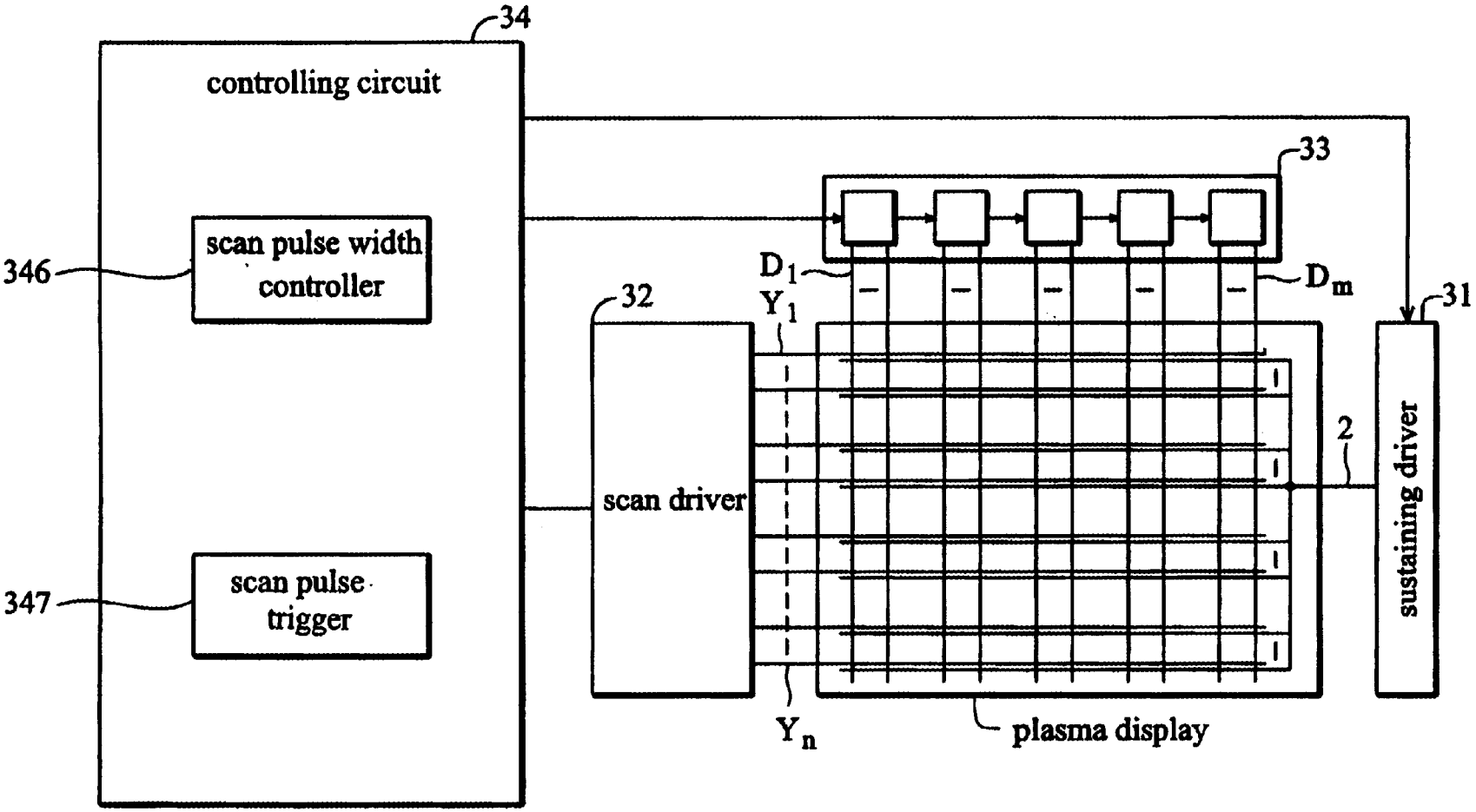
FIGS. 4(*a*) and (4*b*) are block diagrams of the PDP and the drive circuit according to the present invention.
Figure 4B:
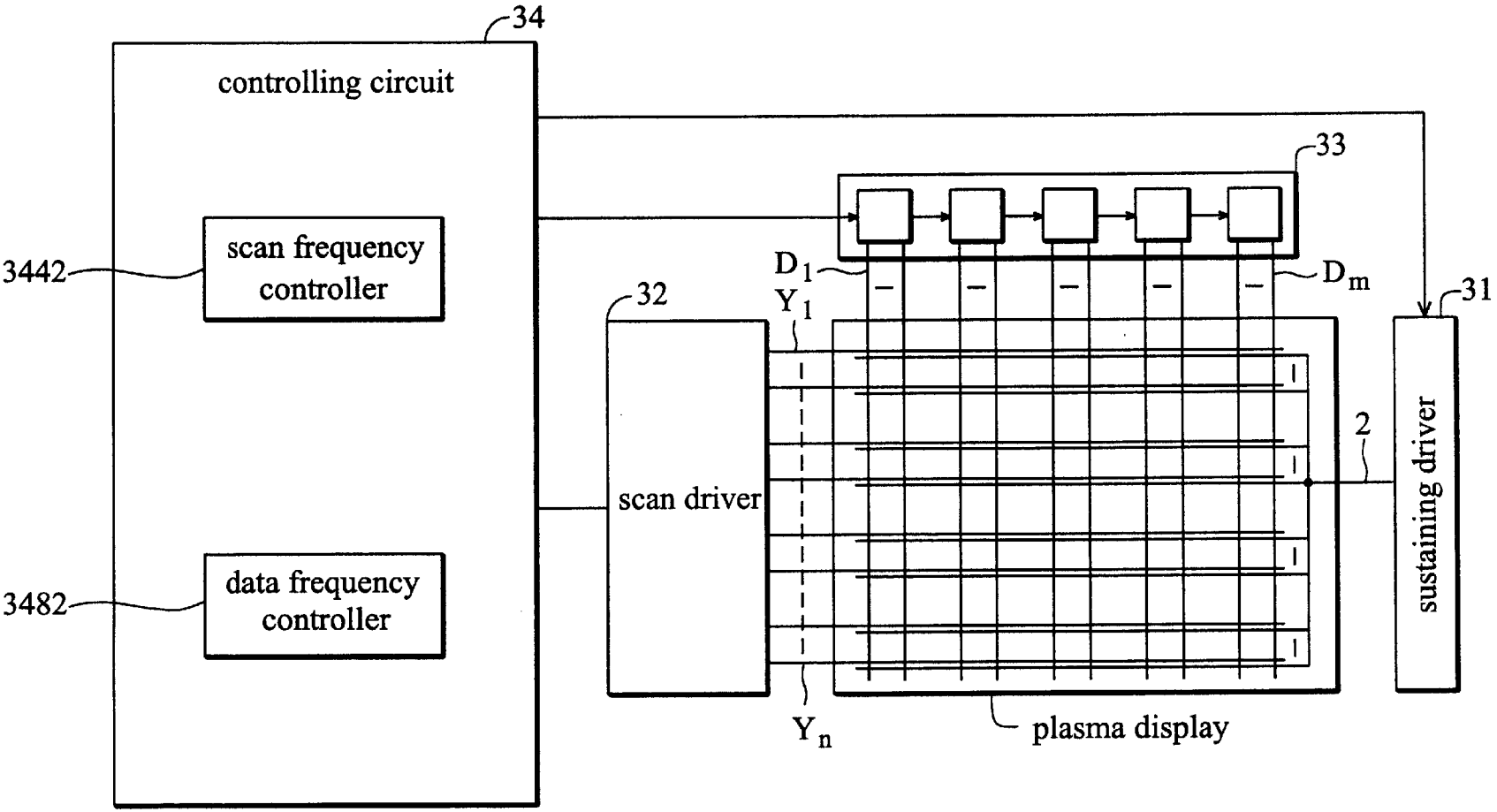

FIGS. 4A and 4B are block diagrams of the PDP and the drive circuit according to the present invention. The scan driver 32 provides scan pulse and sustain discharge pulse to scanning electrodes $Y_1$~$Y_N$. The sustain driver 31 provides sustain discharge pulse to sustain electrode 7. The data driver 33 provides data pulse to data electrodes $D_1$~$D_M$. The controlling circuit 34 controls the operation of the sustain driver 31, the scan driver 32, and the data driver 33.

According to the embodiments of the present invention, the controlling circuit 34 controls the output signal timing of the scan driver 32 and the data driver 33 to decrease the addressing time of the conventional address display separation driving method.

First Embodiment

In FIG. 4A, during addressing period and in the prerequisite of avoiding misfiring, the first scan driving pulse, the second scan driving pulse, and the third scan driving pulse are output in turn by controlling circuit 34. Here, pulse width is getting wider from the first scan driving pulse to the third scan driving pulse, and the periods between the falling edge of the first scan driving pulse and the rising edge of the second scan driving pulse are equal to the periods between the falling edge of the second scan driving pulse and the rising edge of the third scan driving pulse.

In addition, the controlling circuit 34 controls the pulse width of the scan driving pulses received by the first data electrode, the second data electrode, and the third data electrode in turn by the scan pulse width controller 346, and makes the interval between each pulse equal by the scan pulse trigger 347.

Figure 1A:
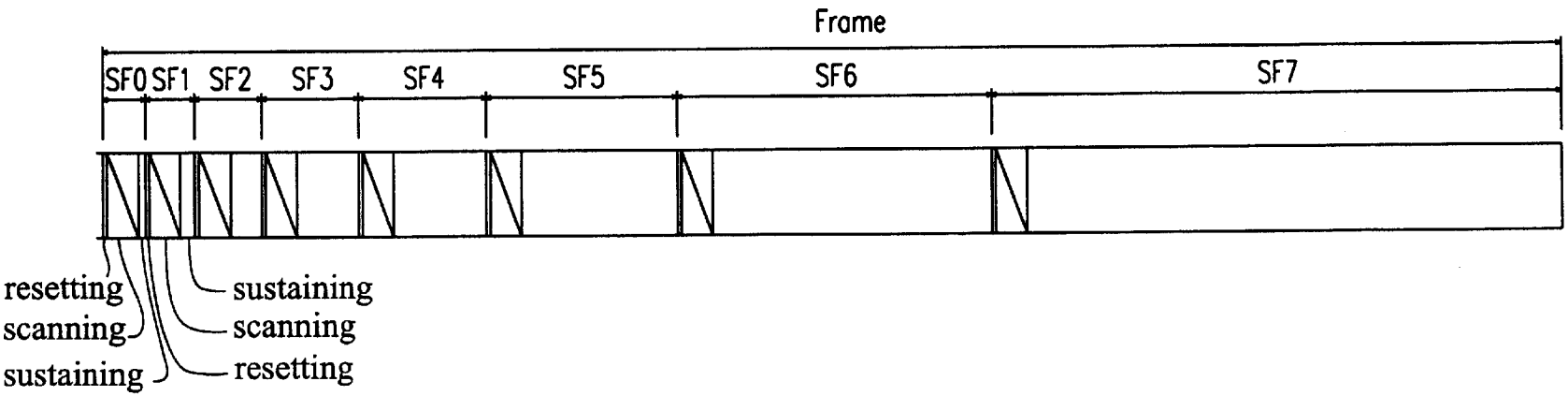
FIG. 1A ( PRIOR ART )
FIG. 1A shows the subframes included in a picture frame in a plasma display panel with 256 gray levels.
Figure 1B:
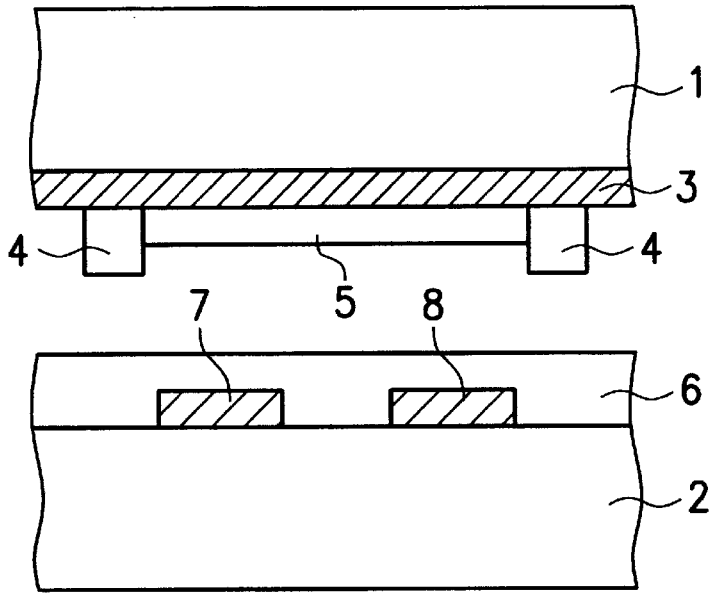
FIG. 1B ( PRIOR ART )
FIG. 1B shows a cross section of a conventional PDP structure.
Figure 1C:
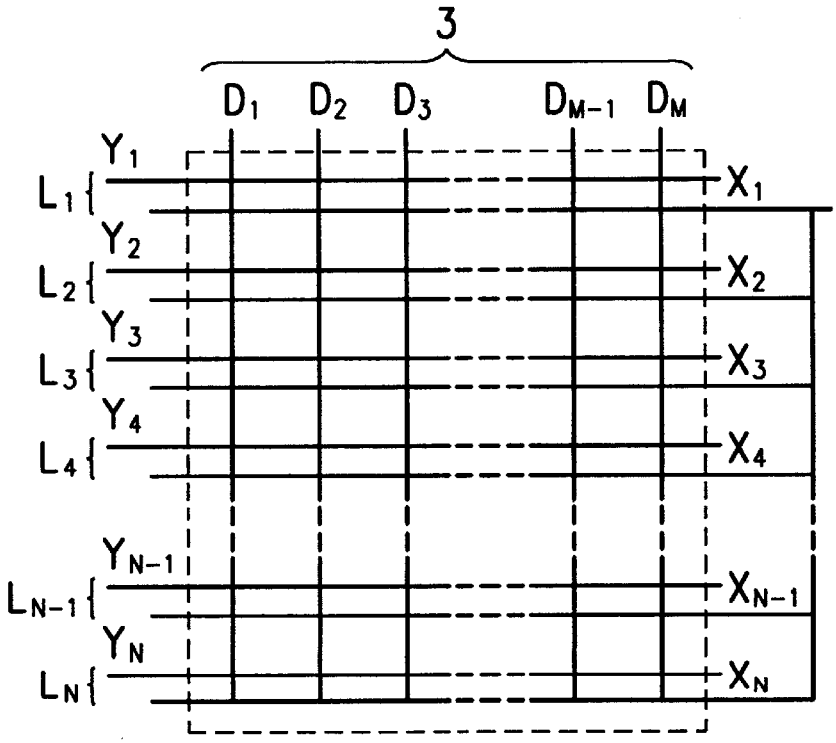
FIG. 1C ( PRIOR ART )
FIGS. 1C and 1D show schematic top views of the data and scanning electrodes of the same PDP.
Figure 1D:
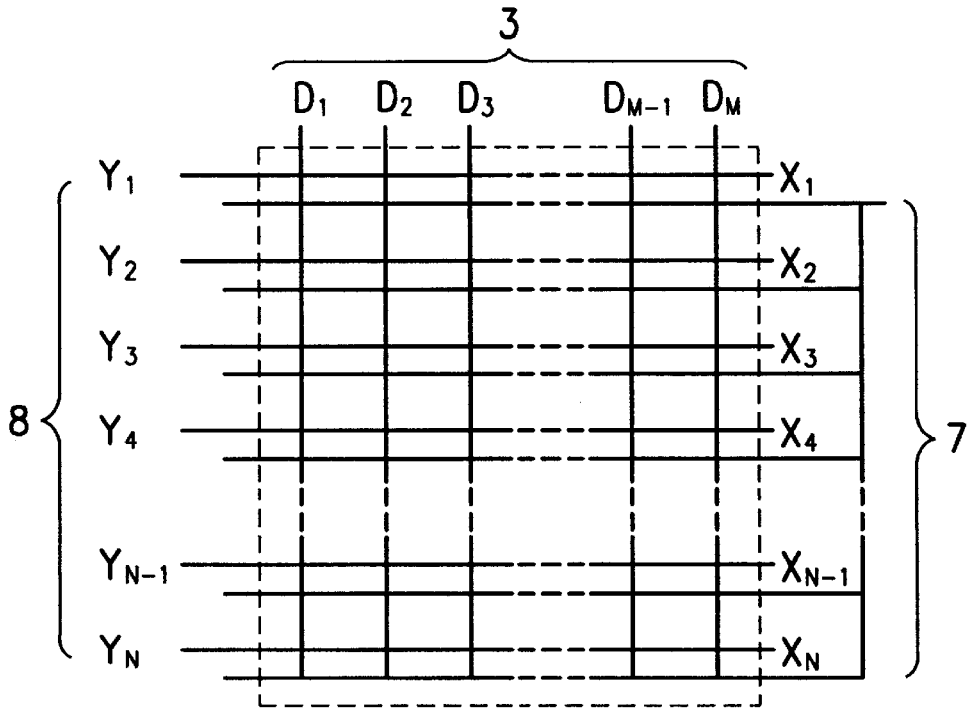
FIG. 1D ( PRIOR ART )
Figure 2:
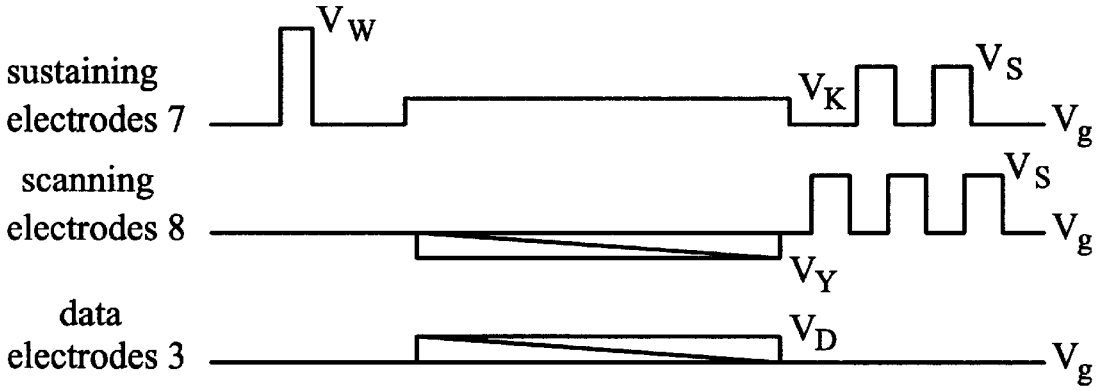
FIG. 2 ( PRIOR ART )
FIG. 2 is a driving signal diagram of various electrodes of the plasma display panel.
Figure 3:
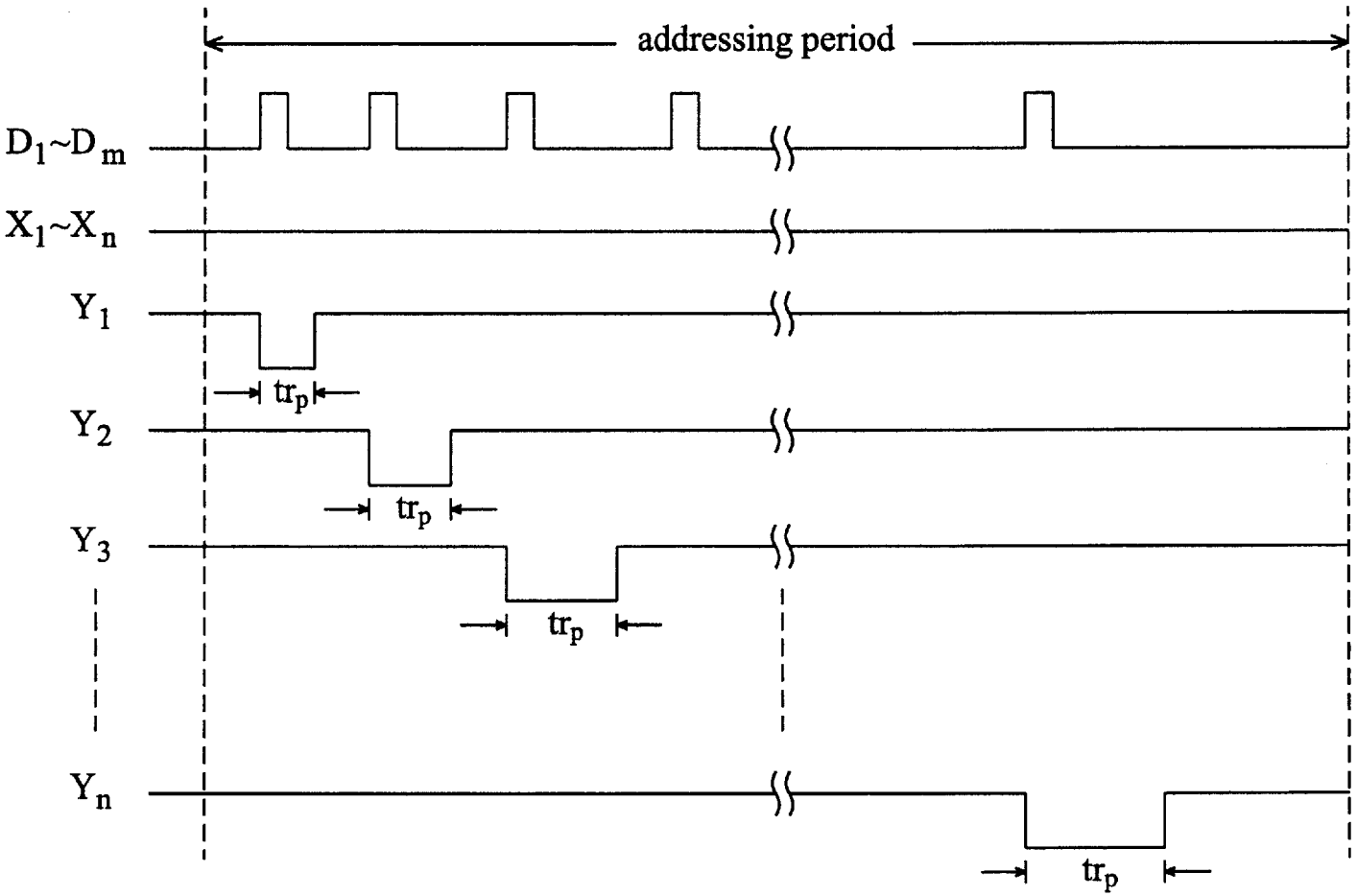
FIG. 3 ( PRIOR ART )
FIG. 3 is a timing chart of the conventional plasma display driving system.
Figure 5:
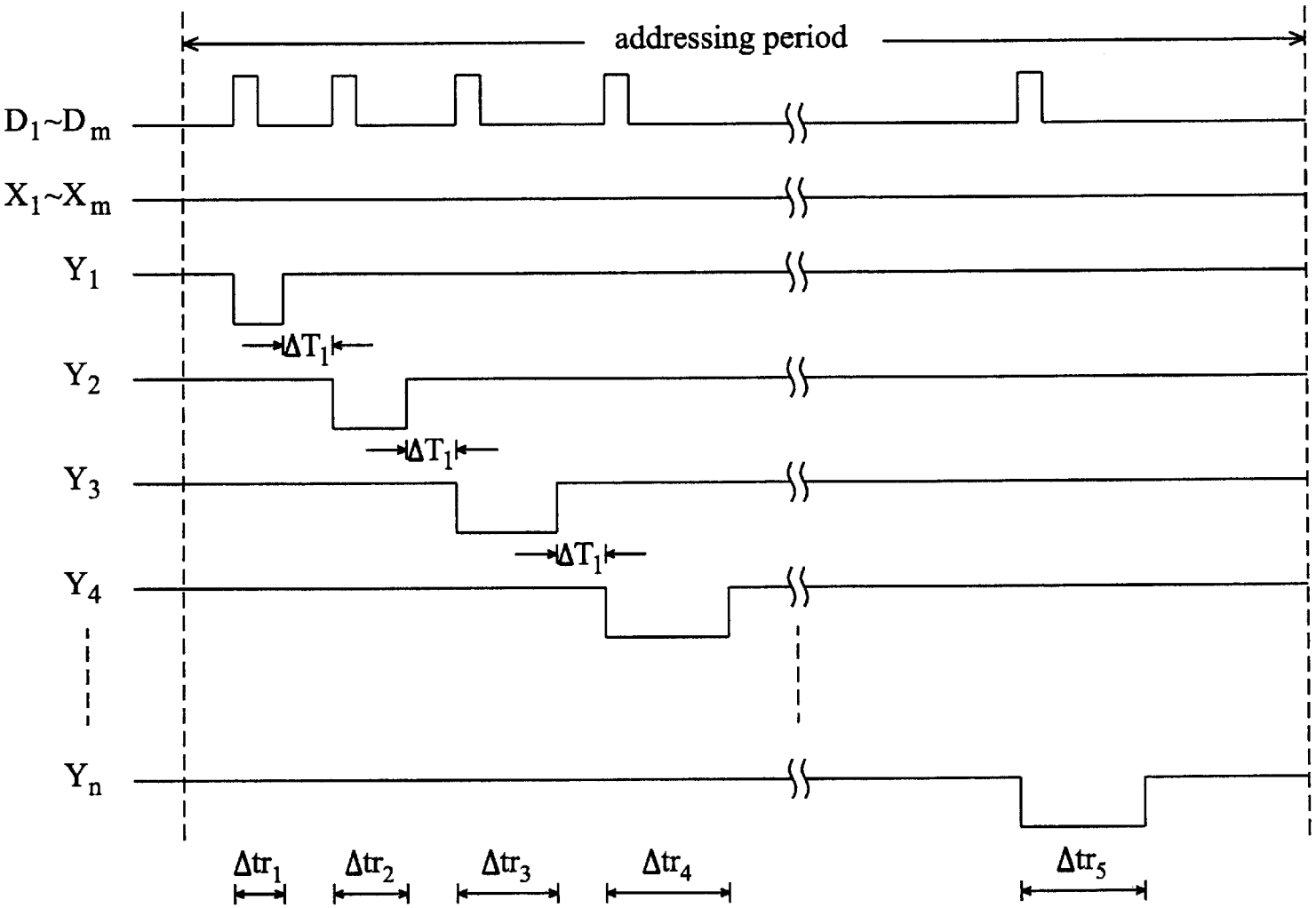
FIG. 5 is a timing chart of the plasma display driving system according to the first embodiment of the present invention.

FIG. 5 is a timing chart of the plasma display driving system according to the first embodiment of the present invention. The scan driver 32 drives the first scanning electrode, the second scanning electrode, and the third scanning electrode according to the responding first scan driving pulse, the second scan driving pulse, and the third scan driving pulse, respectively. The pulse width ($\Delta tr_1$~$\Delta tr_n$) of the pulses output from the scanning electrodes is getting wider. In addition, $\Delta tr_n$ is the same as the $tr_p$ in FIG. 3, and the periods between each pulse are all $\Delta T_1$. Because the pulse width ($\Delta tr_1$~$\Delta tr_{n-1}$) are narrower than the conventional pulse width $tr_p$, the addressing period is decreased. Thus, the first embodiment of the present invention decreases the addressing time by decreasing scan pulse width and scanning time to increase sustaining time, and the brightness of the PDP panel is improved.

Next, data driver 33 drives the data electrodes $D_1$~$D_M$ responding to the scanning electrodes to write data when the scanning electrodes $Y_1$~$Y_N$are driven respectively.

In addition, the present invention can use scan pulses having only two types, but the effect is less conspicuous than with three types.

Second Embodiment

In FIG. 4B, during addressing period and in the prerequisite of avoiding misfiring, the first scan driving pulse, the second scan driving pulse, and the third scan driving pulse are output in turn by controlling circuit 34. Here, pulse width is getting wider from the first scan driving pulse to the third scan driving pulse. Moreover, the frequency of the first scan driving pulse is higher than the second scan driving pulse, and the frequency of the second scan driving pulse is higher than the third scan driving pulse.

In the second embodiment, the controlling circuit 34 controls the first scanning electrodes, the second scanning electrodes, and the third scanning electrodes to output scan pulses with different frequency in turn by the scan frequency controller 3442, the data frequency controller 3482, and data output controller 3413.

The scan driver 32 drives the first scanning electrodes ($Y_1$~$Y_{n1}$), the second scanning electrodes ($Y_{n1+1}$~$Y_{n1+n}$), and the third scanning electrodes ($Y_{n2+1}$~$Y_{n2+n}$) according to the responding first scan driving pulses, the second scan driving pulses, and the third scan driving pulses, respectively.

Figure 6:
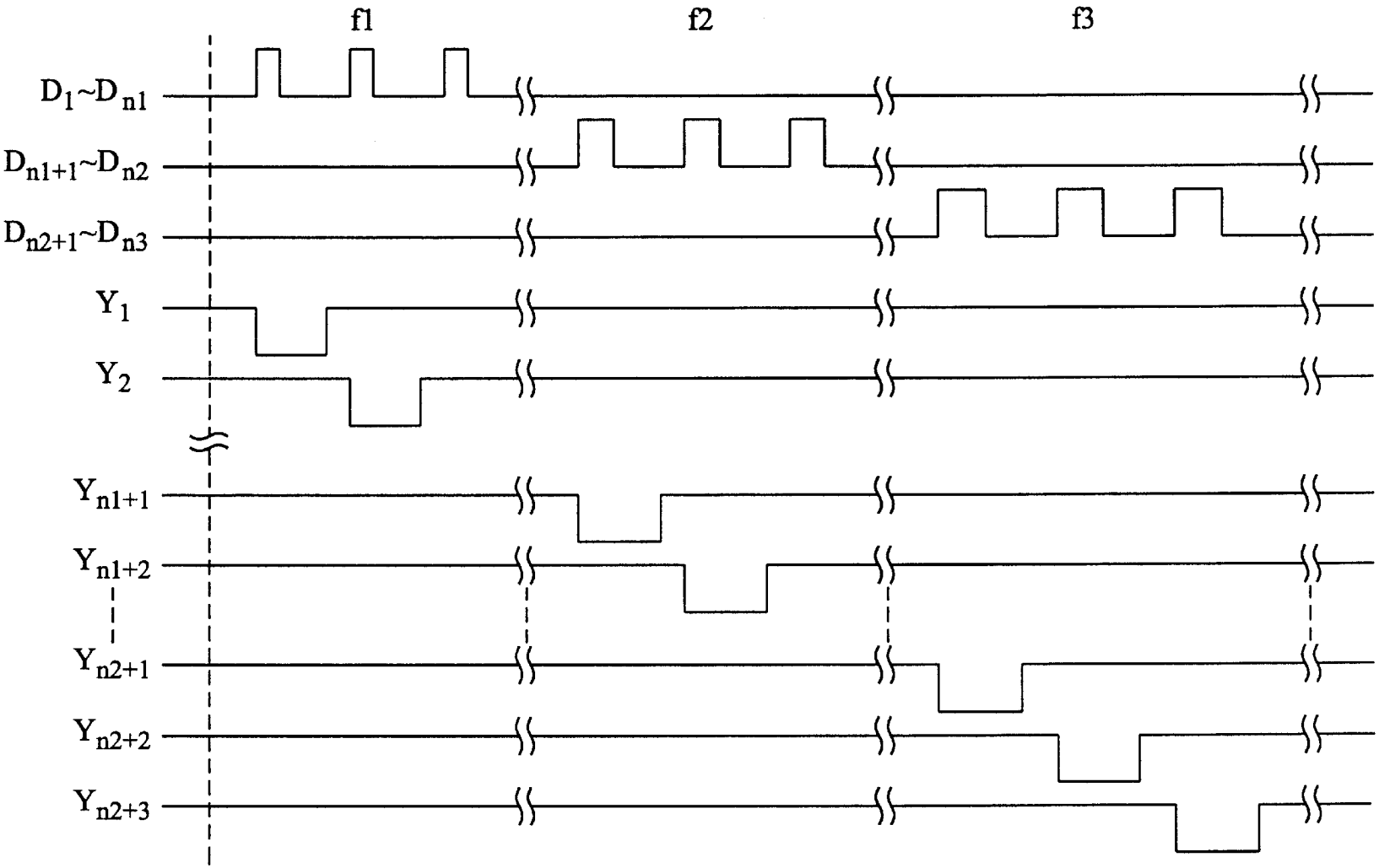
FIG. 6 is a timing chart of the plasma display driving system according to the second embodiment of the present invention.

FIG. 6 is a timing chart of the plasma display driving system according to the second embodiment of the present invention. The output frequency of the first scanning electrodes ($Y_1$~$Y_{n1}$) is $f_1$, the output frequency of the second scanning electrodes ($Y_{n1+1}$~$Y_{n1+n}$) is $f_2$, and the output frequency of the third scanning electrodes ($Y_{n2+1}$~$Y_{n2+n}$) is $f_3$. Here, the output frequency $f_3$ is higher than the conventional output frequency $f_p$ of the scanning electrodes, and the frequency $f_3$ is higher than $f_2$, and the frequency $f_2$ is higher than $f_1$.

Thus, the second embodiment of the present invention decreases the addressing time by increasing the scan frequency, and the brightness of the PDP panel is improved.

Next, data driver 33 drives the data electrodes responding to the scanning electrodes to write data when the scanning electrodes are driven respectively.

In addition, the present invention can use scan pulses with two frequency types, but the effect is less conspicuous than with three.

Third Embodiment

The controlling circuit 34 outputs the first scan driving pulses, the second scan driving pulses, and the third scan driving pulses in turn during addressing period. Here, the pulse width of the first scan driving pulses is narrower than the second scan driving pulses, and the pulse width of the second scan driving pulses is narrower than the third scan driving pulses.

The scan driver 32 drives the first scanning electrodes ($Y_1 \sim Y_n$), the second scanning electrodes ($Y_{n1+1} \sim Y_{n1+n}$), and the third scanning electrodes ($Y_{n2+1} \sim Y_{n2+n}$) according to the responding first scan driving pulses, the second scan driving pulses, and the third scan driving pulses, respectively.

Figure 7:
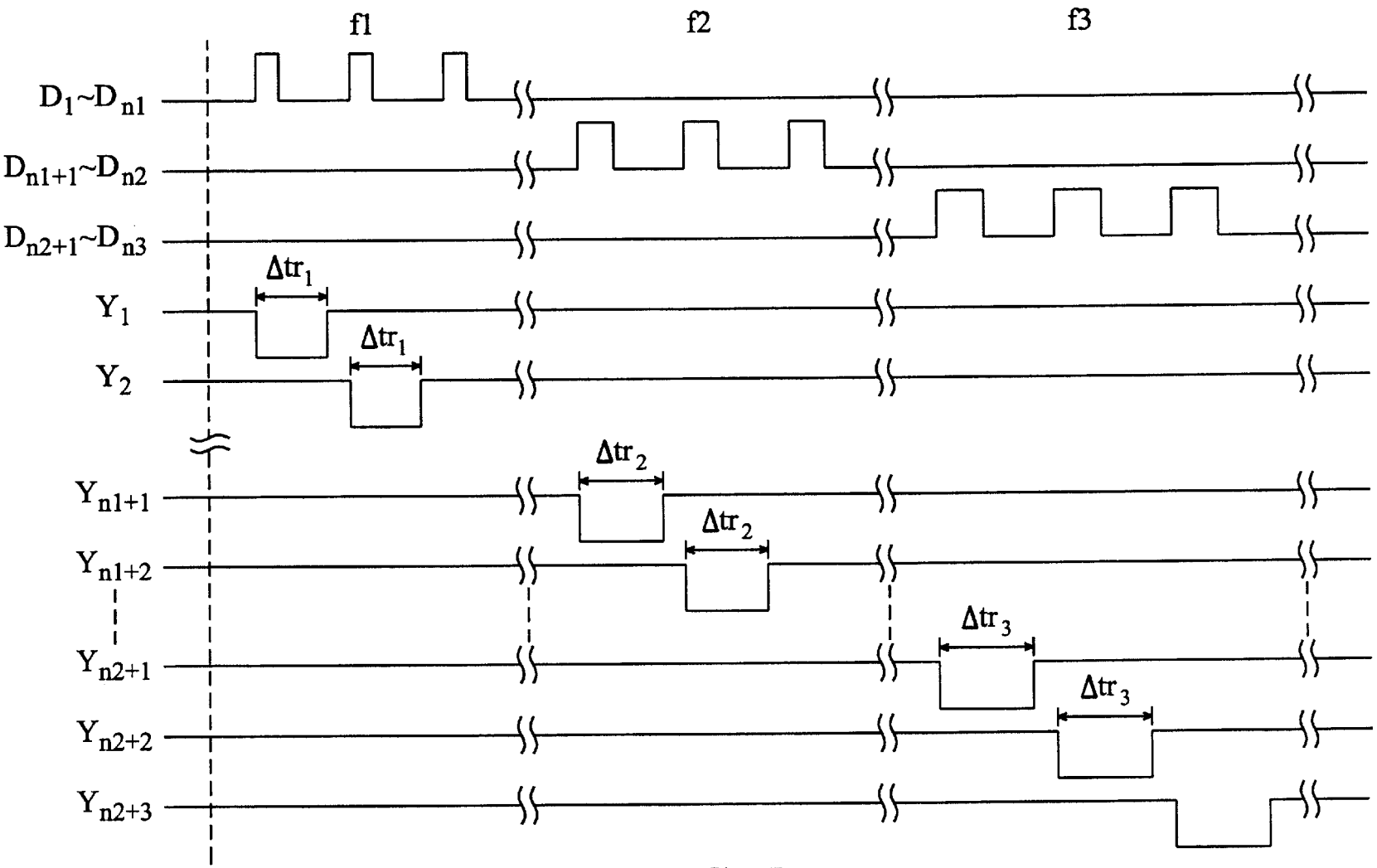
FIG. 7 is a timing chart of the plasma display driving system according to the third embodiment of the present invention.

FIG. 7 is a timing chart of the plasma display driving system according to the third embodiment of the present invention. The pulse width output from the first scanning electrodes ($Y_1 \sim Y_n$) is $\Delta tr_1$, the pulse width output from the second scanning electrodes ($Y_{n1+1} \sim Y_{n1+n}$) is $\Delta tr_2$, and the pulse width output from the third scanning electrodes ($y_{n2+1} \sim Y_{n2+n}$) is $\Delta tr_3$. In the prerequisite of avoiding misfiring, the pulse width $\Delta tr_3$ is less than or equal to the pulse width $tr_p$ output by the conventional scanning electrode. In addition, the pulse width $\Delta tr_3$ is wider than the pulse width $\Delta tr_2$, and the pulse width $\Delta tr_2$ is wider than the pulse width $\Delta tr_1$. Thus, the decreased pulse width will decrease the addressing time, then the sustaining time is increased, so the brightness of the PDP panel is improved.

Next, data driver 33 drives the data electrodes responding to the scanning electrodes to write data when the scanning electrodes $Y_1 \sim Y_N$, $Y_{n1+1} \sim Y_{n1+n}$, and $Y_{n2+1} \sim Y_{n2+n}$ are driven respectively.

In addition, the present invention can use scan pulses having only two types, but the effect is less conspicuous than with three types.

Accordingly, when misfiring does not occur, the frequency, pulse width, and interval of the signals output by the scanning electrodes are modified to decrease addressing period. Thus, the sustaining period is increased to raise the brightness of the PDP.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. A plasma display driving system for driving a plasma display comprising a first scanning electrode and a second scanning electrode responding to a first data electrode and a second data electrode respectively, the system comprising:

a controlling circuit having a scan pulse width controller and a scan pulse trigger for controlling width of a first scan driving pulse and a second scan driving pulse output to the first scanning electrode and the second scanning electrode respectively, wherein the width of the first scan driving pulse is narrower than the second scan driving pulse, and the periods between the falling edge of the first scan driving pulse and the rising edge of the second scan driving pulse are fixed;

a scan driver for driving the first scanning electrode and the second scanning electrode according to the first scan driving pulse and the second scan driving pulse respectively; and a data driver for driving the first data electrode and the second data electrode responding to the first scanning electrode and the second scanning electrode when the first scanning electrode and the second scanning electrode are driven.

2. A method for driving a plasma display comprising a first scanning electrode, a second scanning electrode and a third scanning electrode responding to a first data electrode, a second data electrode and a third data electrode respectively, the method comprising the following steps:

driving the first scanning electrode, the second scanning electrode and the third scanning electrode by a first scan driving pulse, a second scan driving pulse, and a third scan driving pulse respectively during addressing period, wherein the width of the first scan driving pulse is narrower than the second scan driving pulse, the width of the second scan driving pulse is narrower than the third scan driving pulse, and the periods between the falling edge of the first scan driving pulse and the rising edge of the second scan driving pulse are equal to the periods between the falling edge of the second scan driving pulse and the rising edge of the third scan driving pulse; and driving the first data electrode, the second data electrode, and the third data electrode when the responding first scanning electrode, the second scanning electrode and the third scanning electrode are driven.

3. A plasma display driving system for driving a plasma display comprising a plurality of first scanning electrodes and a plurality of second scanning electrodes responding to a plurality of first data electrodes and a plurality of second data electrodes respectively, the system comprising:

a controlling circuit having a scan frequency controller, a data frequency controller and a data output controller for outputting a first scan driving pulse and a second scan driving pulse during addressing period, wherein the frequency of the first scan driving pulse is higher than the second scan driving pulse;

a scan driver for driving the first scanning electrodes and the second scanning electrodes according to the first scan driving pulse and the second scan driving pulse respectively; and a data driver for driving the first data electrodes and the second data electrodes responding to the first scanning electrodes and the second scanning electrodes when the first scanning electrodes and the second scanning electrodes are driven.

4. The plasma display driving system as claimed in claim 3, wherein the controlling circuit further comprises a scan pulse width controller and a scan pulse trigger for controlling width of the first scan driving pulse and the second scan driving pulse output to the first scanning electrode and the second scanning electrode respectively, wherein the width of the first scan driving pulse is narrower than the second scan driving pulse, and the periods between the falling edge of the first scan driving pulse and the rising edge of the second scan driving pulse are fixed.

5. A method for driving a plasma display comprising a plurality of first scanning electrodes, a second plurality of scanning electrodes and a plurality of third scanning electrodes responding to a plurality of first data electrodes, a plurality of second data electrodes and a plurality of third data electrodes respectively, the method comprising the following steps:

driving the first scanning electrodes, the second scanning electrodes and the third scanning electrodes by a first scan driving pulse, a second scan driving pulse, and a third scan driving pulse respectively during addressing period, wherein the frequency of the first scan driving pulse is higher than the second scan driving pulse, and the frequency of the second scan driving pulse is higher than the third scan driving pulse; and driving the first data electrodes, the second data electrodes and the third data electrodes when the responding first scanning electrodes, the second scanning electrodes and the third scanning electrodes are driven.

6. The plasma display driving system as claimed in claim 5, wherein the width of the first scan driving pulse is narrower than the second scan driving pulse, the width of the second scan driving pulse is narrower than the third scan driving pulse.

7. A method for driving a plasma display comprising a plurality of first scanning electrodes, a second plurality of scanning electrodes and a plurality of third scanning electrodes responding to a plurality of first data electrodes, a plurality of second data electrodes and a plurality of third data electrodes respectively, the method comprising the following steps:

driving the first scanning electrodes, the second scanning electrodes and the third scanning electrodes by a first scan driving pulse, a second scan driving pulse, and a third scan driving pulse respectively during addressing period, wherein the width of the first scan driving pulse is narrower than the second scan driving pulse, the width of the second scan driving pulse is narrower than the third scan driving pulse; and driving the first data electrodes, the second data electrodes and the third data electrodes when the responding first scanning electrodes, the second scanning electrodes and the third scanning electrodes are driven.

* * * * *